US005421993A

United States Patent [19]

Hille et al.

[11] Patent Number: 5,421,993

[45] Date of Patent: Jun. 6, 1995

[54] PROCESS OF INHIBITING CORROSION, DEMULSIFYING AND/OR DEPRESSING THE POUR POINT OF CRUDE OIL

[75] Inventors: Martin Hille, Liederbach; Rainer Kupfer, Hattersheim; Roland Böhm, Kelkheim, all of Germany

[73] Assignee: Hoechst AG, Frankfurt, Germany

[21] Appl. No.: 109,335

[22] Filed: Aug. 19, 1993

[30] Foreign Application Priority Data

Aug. 22, 1992 [DE] Germany ..... 42 27 911.9

[51] Int. Cl.[6] ..... C10G 75/02; B01D 17/04

[52] U.S. Cl. ..... 208/47; 208/48 AA; 252/344

[58] Field of Search ..... 208/47, 48 AA; 252/344, 252/341

[56] References Cited

U.S. PATENT DOCUMENTS

| | | | |
|---|---|---|---|
| 4,885,110 | 12/1989 | Böse et al. | 252/341 |
| 4,935,162 | 6/1990 | Barthold et al. | 252/344 |
| 5,039,450 | 8/1991 | Kupfer et al. | 252/331 |
| 5,194,068 | 3/1993 | Mohr et al. | 44/391 |

FOREIGN PATENT DOCUMENTS

| | | |
|---|---|---|
| 0267517 | 5/1988 | European Pat. Off. . |
| 0333141 | 9/1989 | European Pat. Off. . |
| 0464489 | 1/1992 | European Pat. Off. . |

*Primary Examiner*—Linda Skaling
*Assistant Examiner*—Lorna M. Douyon
*Attorney, Agent, or Firm*—Connolly & Hutz

[57] ABSTRACT

The invention relates to the use of oxyalkylated fatty amines and fatty amines of the formula (I)

$$A-[(CH_2-CH_2-O)_x-(CH_2-\underset{\underset{CH_3}{|}}{CH}-O)_y-(CH_2-CH_2-O)_z-H]_n \quad (I)$$

in which

A is a radical of the formula (II)–(V)

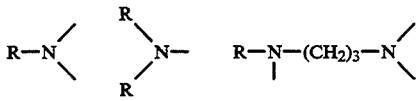

(II) n = 2 (III) n = 1 (IV) n = 3

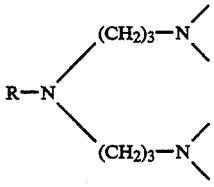

(V) n = 4 in which R is $C_6$–$C_{22}$-alkyl, x is a number from 5 to 40, y is a number from 5 to 70 and z is 0–70% by weight of ethylene oxide, based on compounds of the formula (I) having x ethylene oxide units and y propylene oxide units, as demulsifiers, corrosion inhibitors and/or pour point depressants in crude oils.

16 Claims, No Drawings

PROCESS OF INHIBITING CORROSION, DEMULSIFYING AND/OR DEPRESSING THE POUR POINT OF CRUDE OIL

The crude oil produced usually comprises a number of troublesome concomitant substances, such as water, inorganic salts and paraffins and asphaltenes, which are usually removed before transportation or storage. Corrosion and microbiological growth often occur in the components of pipelines and tank installations wetted with water due to water-in-oil emulsions. By using suitable demulsifiers, the water-in-oil emulsions are split and the water content and salt content of the crude oil is thus lowered. If the crude oils comprise relatively large amounts of paraffins and asphaltenes, they have a high pour point, which sometimes leads to deposits in the production probes and especially in the pipelines and can shut down production and pumping of the crude oil. To avoid these disadvantages, it has been customary to date to add specific additives to the crude oil for demulsification, corrosion inhibition, disinfection and inhibition of paraffin and asphaltene deposits.

U.S. Pat. No. 2,557,081 describes the use of oxyalkylated alkylphenol/formaldehyde resins as demulsifiers. The use of polyalkylene oxide block polymers as demulsifiers is known from U.S. Pat. No. 2,674,619 and U.S. Pat. No. 2,677,700. U.S. Pat. No. 3,974,220 describes the use of alkyldiamine salts and alkylammonium compounds as demulsifiers having a corrosion-inhibiting action. The use of oxyethylated amines, also in combination with ethylene copolymers, as pour point depressants is known from EP-A-186 009.

In spite of the known additives, it is still desirable to have compounds which allow use as a corrosion inhibitor, demulsifier and pour point depressant.

The invention relates to the use of oxyalkylated fatty amines and fatty amine derivatives of the formula (I)

$$A-[(CH_2-CH_2-O)_x-(CH_2-\underset{\underset{CH_3}{|}}{CH}-O)_y-(CH_2-CH_2-O)_z-H]_n \quad (I)$$

in which

A is a radical of the formula (II)–(V)

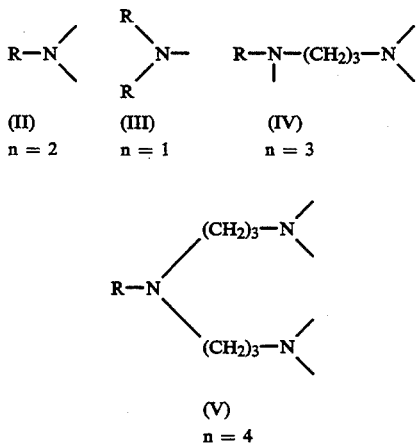

(II) n = 2 (III) n = 1 (IV) n = 3

(V) n = 4 in which R is $C_6$–$C_{22}$-alkyl, preferably $C_8$–$C_{18}$-alkyl, x is a number from 5 to 40, preferably 8 to 20, y is a number from 5 to 70, preferably 10–30, and z is 0–70 % by weight, preferably 0–40 % by weight, of ethylene oxide, based on compounds of the formula (I) having x ethylene oxide units and y propylene oxide units, as demulsifiers, corrosion inhibitors and/or pour point depressants.

Radicals of the formula (I) without A are attached to the free valencies of the nitrogen atoms of the radicals of the formula (II) to (V). The compounds of the formula (I) are prepared by reaction of amines of the formula (II) to (V) with ethylene oxide and propylene oxide with addition of bases, such as alkali metal hydroxides.

The reaction is carried out in several stages at temperatures in the range of 100°–150° C., preferably 130°–140° C. The amount of catalyst/base employed is usually 0.5 to 3.0 % by weight, based on the starting amine employed. The molar amount of ethylene oxide and propylene oxide per mole of starting amine corresponds to the values stated for x and y and the percentages by weight stated for z.

In the preferred preparation form of the oxyalkylated fatty amines and fatty amine derivatives of the formula (I), the amine of the formula (II), (III), (IV) and/or (V) which has been initially introduced is heated to a temperature of approximately 130° to 140° C. and is first reacted with 1 mol of ethylene oxide per equivalent of NH function, after which the alkali metal hydroxide is added as a powder or in the form of an aqueous solution. If an aqueous, preferably 40% strength by weight aqueous solution is added, it is necessary to remove the water present before addition of the remaining amounts of ethylene oxide. This is effected in a simple and gentle manner by applying a vacuum. The resulting oxyethylate which has been rendered alkaline is then reacted with the desired remaining amount of ethylene oxide, likewise at 130° C. When the addition of ethylene oxide has ended, the reaction mixture is kept at a temperature of approximately 130° to 140° C. for several hours for after-reaction. The end of the reaction is indicated by a constant pressure of approximately one bar. It has been found that because of the exothermic reaction, it is advantageous to add the remaining amount of ethylene oxide mentioned in several stages. This can be achieved by a stepwise addition in small amounts or by a continuous addition. The reaction temperature is in the range from 130 to 140° C. and the pressure is approximately 3–4 bar. The addition lasts several hours, on average 6–8 hours, depending on the amount of ethylene oxide. When the addition has ended, as mentioned, the reaction mixture is kept at a temperature of 130° to 140° C. for several hours, preferably 2 hours. The end of the reaction is indicated by a constant pressure of approximately one bar. The resulting finished oxyethylate is reacted with propylene oxide in a further stage. This addition of propylene oxide is carried out at a temperature in the range from 100° to 150° C., preferably in the range from 130°–140° C., the desired amount of propylene oxide usually being added at the rate at which it reacts. During the addition, the pressure in the reaction vessel rises to approximately 3–4 bar. When the addition has ended, which as a rule takes up to 10 hours, the reaction mixture is kept at a temperature in the range of approximately 130° to 140° C. until the end of the reaction is indicated by a constant pressure in the region of one bar.

The ethoxylated and propoxylated compounds of the formula (I) thus prepared can be reacted with additional ethylene oxide in a further stage. The amount added here is in the range from 0 to 70% by weight of ethylene oxide, based on compounds of the formula (I) having x ethylene oxide units and y propylene oxide units. This further addition of ethylene oxide after the propoxylation has already been carried out is effected analogously to the reaction with propylene oxide, but additional alkalification can be dispensed with. The compounds of the formula (I) are used as additives for crude oils, acting both as demulsifiers, corrosion inhibitors and pour point depressants.

Preparation Examples

The terms used below for characterization, such as alkali number and iodine color number, are determined or ascertained as follows:

Determination of the Alkali Number

To determine the alkali number, stated in mg of KOH/g of substance, 0.1 to 0.5 g of the sample is weighed into a 150 ml glass beaker and dissolved in 60 to 80 ml of ethanol and the solution is titrated with 0.1N ethanolic potassium hydroxide solution. The end point is indicated potentiometrically (apparatuses: Metrohm Titroprocessor 682, Dosimat 665 with combined pH glass electrode).

Iodine Colour Number

The iodine colour number is the concentration of free iodine in an iodine/potassium iodide solution (in mg of iodine per 100 ml of iodine/potassium iodide solution) and serves to characterize the color or transparency of this solution and liquids of a similar type. The basis for determination of the iodine color number is the iodine color scale (comparison tubes). Literature: DIN 53403.

The following embodiment examples illustrate the present invention without limiting this.

EXAMPLE 1

1st stage 50 g (0.19 mol) of tallow fat amine (amine of the formula (I) in which R=$C_{14}$-(5%), $C_{16}$-(30%) and $C_{18}$-(5%)-alkyl; iodine number=45; alkali number: 210 mg of KOH/g of substance; molecular weight: 267) are initially introduced into a 1 liter stirred autoclave and heated to 130° C. 16.7 g (0.38 mol) of ethylene oxide (EO) are added at this temperature. During this addition, the pressure rises to 4 bar. When the addition has ended, the mixture is allowed to after-react at 130° C. for 2 hours. The end of the reaction is indicated by a constant pressure of 1 bar.

2nd Stage 3.2 g of a 40% strength aqueous KOH solution are then added to the contents of the autoclave and the water is removed under a water pump vacuum at 80° C. in the course of 2 hours. Ethylene oxide (EO) (166.3 g, 3.78 mol) is added to the fatty amine oxylate, which has been rendered alkaline, at the rate at which it reacts. During this operation, the pressure in the autoclave rises to 3–4 bar and the reaction temperature is between 130° and 140° C. (reaction duration 8 hours). When the addition has ended, the mixture is after-reacted at 130° C. for a further 2 hours, after which the pressure remains constant at 1 bar, indicating the end of the reaction.

3rd Stage

Propylene oxide (PO) (364 g, 6.27 mol) is now added to the above product, without further isolation, at 120° C. at the rate at which it reacts. During this operation, the pressure rises to a maximum of 3 bar and the temperature rises to a maximum of 130° C. The addition has ended after about 10 hours; after-reaction is carried out at 130° C. for 2 hours, after which the pressure remains constant at 1 bar, indicating the end of the reaction. The product thus obtained is a pale yellow, pasty mass having an alkali number of 22.5 mg of KOH/g of substance and a turbidity point of 44.1° C. (in accordance with DIN 53917). All the turbidity points were determined with a weight of 5 g (product) per 25 g of a 25% strength aqueous butyldiglycol solution.

EXAMPLE 2

The product is prepared analogously to Example 1. Amounts employed:

1st Stage 160.8 g (0.32 mol) of di-tallow fat amine (amine of the formula (III), in which R has the meaning given in Example 1: iodine number: 50; alkali number: 111.7 mg of KOH/g of substance; molecular weight 502.5 g/mol). 14.1 g (0.32 mol) of ethylene oxide (EO)

2nd Stage 2.2 g of 40% strength aqueous KOH solution 70.4 g (1.6 mol) of ethylene oxide (EO)

3rd Stage 167.3 g (2.88 mol) of propylene oxide (PO)

The product is an almost colorless, pasty mass having an alkali number of 45.0 mg of KOH/g of substance. The turbidity point according to DIN 53971 cannot be determined.

EXAMPLE 3

The product is prepared analogously to Example 1. Amounts employed:

1st Stage 80.0 g (0.21 mol) of tallow fat dipropylenetriamine (amine of the formula (V) in which R has the meaning given in Example 1: iodine number: 32; alkali number: 433.1 mg of KOH/g of substance, molecular weight: 388.6 g/mol). 36.3 g (0.82 mol) of ethylene oxide (EO)

2nd Stage 3.6 g of 40% strength aqueous KOH solution 163.2 g (3.70 mol) of ethylene oxide (EO)

3rd Stage 394.6 g (6.80 mol) of propylene oxide (PO)

The product is a pale brown, clear liquid having an alkali number of 56.2 mg of KOH/g of substance, and has a turbidity point of 41.8° C. (in accordance with DIN 53917).

EXAMPLE 4

The product is prepared analogously to Example 1.

1st Stage 51.1 g (0.15 mol) of tallow fat propylenediamine (amine of the formula (IV) in which R has the meaning given in Example 1: iodine number 36; alkali number:

329 mg of KOH/g of substance; molecular weight: 340.7 g/mol).

19.8 g (0.45 mol) of ethylene oxide (EO)

2nd Stage 2.6 g of 40% strength aqueous KOH solution 125.5 g (2.85 mol) of ethylene oxide (EO)

3rd Stage 287.5 g (4.95 mol) of propylene oxide (PO)

The product is a pale yellow, clear liquid; it has an alkali number of 32.5 mg of KOH/g of substance and a turbidity point of 37.9° C. (in accordance with DIN 53917).

Preparation of the precursor for Example 5 and 6

The precursor

1st Stage 100.5 g (0.2 mol) of di-tallow fat amine (amine of the formula (III ); for the composition, cf. Example 2 ) 8.8 g (0.2 mol) of ethylene oxide (EO)

2nd Stage 3.4 g of 40% strength aqueous KOH solution 96.9 g (2.2 mol) of ethylene oxide (EO)

3rd Stage 325.2 g (5.6 mol) of propylene oxide (PO)

EXAMPLE 5

530 g of the alkoxylated amine of stage 3 are reacted without further isolation with 132.5 g of ethylene oxide (EO) (=25% by weight, based on the alkoxylated amine of stage 3; Δz in Table 1). The reaction is carried out analogously to Example I, stage 2 (without the alkalization step).

The product is a pale brown, slightly turbid liquid having an alkali number of 18.8 mg of KOH/g of substance and a turbidity point of 52.2° C. (in accordance with DIN 53917).

EXAMPLE 6

530 g of the alkoxylated amine of stage 3 are reacted, without further isolation, with 79.5 g of ethylene oxide (EO) (=15% by weight, based on the precursor; Δz in Table 1). The reaction is carried out analogously to Example 1, stage 2 (without the alkalization step).

The product is a pale brown, slightly turbid liquid; it has an alkali number of 20.4 mg of KOH/g of substance and a turbidity point of 42.7° C. (in accordance with DIN 53917).

Use Examples a) Demulsification

For this, the crude oil emulsions are introduced into so-called torpedo glasses. Torpedo glasses are distinguished by the fact that they narrow sharply at the bottom and have a scale division, which means that small volumes of water separated out can easily be read off. A defined amount of demulsifier is in each case added, by means of a micro-metering syringe, to the torpedo glasses filled with the crude oil emulsions. The glasses are then shaken thoroughly in order to distribute the demulsifiers as homogeneously as possible in the crude oil emulsions. The torpedo glasses filled with crude oil emulsion and demulsifier are then placed in a temperature-controlled water-bath and the amounts of water which have separated out are read off at constant intervals of time. The amounts of water which have separated out are stated in milliliters (ml) or in percent (%), based on the total amount of water present in the crude oil emulsion. The total amount of water present in the crude oil emulsion must be determined before the demulsification experiment, as must the amount of demulsifier metered in and the optimum breaking temperature.

The crude oil emulsion of northern German origin used in the experiments has a water content of about 68% and a salt content of about 18%. An amount of emulsion of 100 $cm^3$ is employed in the experiments; the dewatering temperature is 50° C. The amount (concentration) of demulsifier used in Examples 1–6 is in each case 30 ppm. Table 1 shows the characteristic data of the compounds of the formula I employed.

| | Compounds of the formula I | | | | |
|---|---|---|---|---|---|
| Example | A | R | x [EO] | y [PO] | z |
| 1 | II | $C_{14}$–$C_{18}$-alkyl, unsaturated | 22 | 33 | — |
| 2 | III | $C_{14}$–$C_{18}$-alkyl, unsaturated | 6 | 9 | — |
| 3 | V | $C_{14}$–$C_{18}$-alkyl, unsaturated | 22 | 33 | — |
| 4 | IV | $C_{14}$–$C_{18}$-alkyl, unsaturated | 22 | 33 | — |
| 5 | III | $C_{14}$–$C_{18}$-alkyl, unsaturated | 12 | 28 | 25 |
| 6 | III | $C_{14}$–$C_{18}$-alkyl, unsaturated | 12 | 28 | 15 |

The amount of water which has separated out after 30, 60, 90, 180, 240 and 300 minutes is stated in % of the total water (Table 2 ) .

| | Time/Minutes | | | | | |
|---|---|---|---|---|---|---|
| Example | 30 | 60 | 90 | 180 | 240 | 300 |
| 1 | 2 | 14 | 32 | 66 | 88 | 92 |
| 2 | 1 | 4 | 12 | 28 | 42 | 72 |
| 3 | 8 | 26 | 74 | 96 | 98 | 100 |
| 4 | 12 | 36 | 80 | 96 | 98 | 100 |
| 5 | 20 | 48 | 84 | 98 | 100 | 100 |
| 6 | 16 | 35 | 72 | 86 | 96 | 98 |

The results show that the compounds according to the invention have an excellent demulsifying action.

b) Corrosion inhibition

Testing is carried out by the Shell wheel test. In this, coupons of 15 $cm^2$ surface of the steel 1.1203 are aged dynamically in a mixture of salt water (5% by weight of NaCl) and petroleum (9:1) in a $CO_2$ atmosphere at 70° C. for 24 hours, the pH of the aqueous phase being brought to 3.5 with acetic acid. The coupons are then cleaned and the weight loss is determined. This test is a standard test for oilfield corrosion inhibitors.

The inhibit ion values in % o f the compounds of the formula (I) are shown in Table 3. The inhibition value is the reduction in removal of material, i.e. in corrosion, compared with coupons without inhibitor in the liquid mixture.

TABLE 3

| | Amount employed in ppm | | |
|---|---|---|---|
| Example | 5 | 10 | 50 |
| 1 | 54 | 80 | 86 |
| 2 | 66 | 84 | 90 |

TABLE 3-continued

| Example | Amount employed in ppm 5 | 10 | 50 |
|---|---|---|---|
| 3 | 70 | 82 | 88 |
| 4 | 68 | 83 | 87 |
| 5 | 48 | 78 | 83 |
| 6 | 52 | 80 | 84 |

The inhibition values achieved in this way in the laboratory test suggest a good corrosion inhibition in the oil-field.

c) Paraffin dispersion

For this, crude oil is pumped in a circulation system above the temperature at which paraffin separates out. This circulation system contains a U-shaped tube which can be immersed in a cooling bath. The bath and cooling temperature are determined empirically, i.e. the time within which the U-tube becomes blocked with paraffin which has crystallized out must be investigated. This is measured by the increase in the pump output or by the rise in pressure. Inhibitors prolong the time within which the U-tube becomes blocked and the pressure or output of the pump reaches the same critical value. In the laboratory, the conditions are chosen with a time lapse such that the experiment has ended in about 6 to 8 hours; i.e. without addition of inhibitor, the critical values must be obtained after one to not more than 2 hours. The ratio of the time with inhibitor to without inhibitor (=time factor) is a measure of the inhibitor action of the individual products.

The following time factors were achieved using an amount of 200 ppm (Table 4):

| Example | Crude oil I | Crude oil II |
|---|---|---|
| 1 | 3.5 | 3.8 |
| 2 | 1.5 | 1.8 |
| 3 | 3.8 | 4.2 |
| 4 | 4.6 | 4.4 |
| 5 | 4.4 | 4.6 |
| 6 | 3.8 | 4.6 |

These test results show that the compounds according to the invention noticeably delay paraffin deposits. In practice, this means: in probes with mild paraffin problems, blockage can be avoided by using the compounds according to the invention; or if paraffin deposits are severe, the intervals between mechanical or thermal treatment of probes can be greatly extended. This is very important for poorly accessible, remote oilfields.

We claim:

1. The process of inhibiting corrosion, demulsifying and/or depressing the pour point of crude oil which comprises adding an effective amount of an oxyalkylated fatty amide or fatty amine derivative of the formula (I)

$$A-\{(CH_2-CH_2-O)_x-(CH_2-\underset{\underset{CH_3}{|}}{CH}-O)_y-(CH_2-CH_2-O)_z-H\}_n \quad (I)$$

in which

A is a radical of the formula (III)-(V)

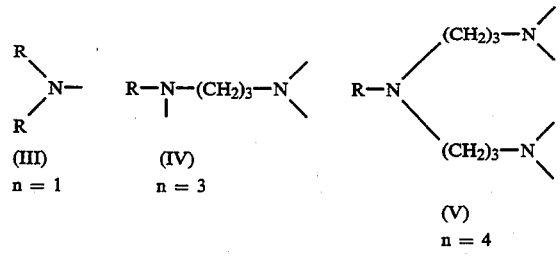

in which

R is $C_6$–$C_{22}$-alkyl, x is a number from 5 to 40, y is a number from 5 to 70, and z is 0 to 70% by weight of ethylene oxide, based on the compound of the formula (I) having x ethylene oxide units and y propylene oxide units, to the crude oil.

2. The process as claimed in claim 1 in which

R is $C_8$–$C_{18}$-alkyl, x is a number from 8 to 20, y is a number from 10 to 30 and z is 0 to 40% by weight of ethylene oxide, based on the compound of the formula (I) having x ethylene oxide units and y propylene oxide units.

3. The process as claimed in claim 1, wherein the oxyalkylated fatty amine or fatty amine derivative of the formula (I) is added to the crude oil in an amount of from 2 to 2000 ppm.

4. The process as claimed in claim 1, wherein A is a radical of the formula (III).

5. The process as claimed in claim 1, wherein A is a radical of the formula (IV).

6. The process as claimed in claim 1, wherein A is a radical of the formula (V).

7. The process as claimed in claim 1, wherein the oxylated fatty amine or fatty amine derivative of formula (I) is homogeneously mixed in the crude oil; placed in a temperature controlled water bath, and then separating amounts of water out.

8. The process as claimed in claim 1, wherein x is a number from 12 to 22 and y is a number from 9 to 33 and z is a number from 0 to 25.

9. The process as claimed in claim 8, wherein y is a number from 28 to 33 and z is a number from 15 to 25.

10. The process as claimed in claim 8, wherein Z is a number from 15 to 25.

11. The process as claimed in claim 8, wherein R is an unsaturated $C_{14}$–$C_{18}$-alkyl.

12. The process as claimed in claim 11, wherein A is a radical of formula III.

13. The process as claimed in claim 11, wherein A is a radical of formula IV.

14. The process as claimed in claim 11, wherein A is a radical of formula V.

15. The process as claimed in claim 1 wherein y is a number from 28 to 70.

16. The process as claimed in claim 15, wherein x is a number from 12 to 40.

* * * * *